US007210856B2

(12) United States Patent
Ringgenberg

(10) Patent No.: US 7,210,856 B2
(45) Date of Patent: May 1, 2007

(54) DISTRIBUTED TEMPERATURE SENSING IN DEEP WATER SUBSEA TREE COMPLETIONS

(75) Inventor: Paul D. Ringgenberg, Frisco, TX (US)

(73) Assignee: WellDynamics, Inc., Spring, TX (US)

( * ) Notice: Subject to any disclaimer, the term of this patent is extended or adjusted under 35 U.S.C. 154(b) by 152 days.

(21) Appl. No.: 10/790,908

(22) Filed: Mar. 2, 2004

(65) Prior Publication Data

US 2005/0194150 A1 Sep. 8, 2005

(51) Int. Cl.

| | |
|---|---|
| ***G02B 6/36*** | (2006.01) |
| ***G02B 6/00*** | (2006.01) |
| ***G01V 3/00*** | (2006.01) |
| ***G01D 9/00*** | (2006.01) |

(52) U.S. Cl. ..... 385/53; 385/12; 340/853.1; 346/25

(58) Field of Classification Search ..... 367/25; 385/12, 53; 346/33; 340/853.1; 250/227.14–18
See application file for complete search history.

(56) References Cited

U.S. PATENT DOCUMENTS

| | | | | |
|---|---|---|---|---|
| 4,134,455 | A | 1/1979 | Read | |
| 4,375,237 | A | 3/1983 | Churchman | |
| 4,442,893 | A | 4/1984 | Foust | |
| 4,483,584 | A | 11/1984 | Gresty | |
| 4,624,309 | A | 11/1986 | Schnatzmeyer | |
| 4,690,212 | A | 9/1987 | Termohlen | |
| 4,756,595 | A * | 7/1988 | Braun et al. | 385/75 |
| 4,757,859 | A | 7/1988 | Schnatzmeyer | |
| 4,825,946 | A | 5/1989 | Schnatzmeyer | |
| 4,828,027 | A | 5/1989 | Schnatzmeyer | |
| 4,846,269 | A | 7/1989 | Schnatzmeyer | |
| 4,887,883 | A | 12/1989 | Darbut et al. | |
| 4,921,438 | A | 5/1990 | Godfrey et al. | |
| 5,048,610 | A | 9/1991 | Ross et al. | |
| 5,251,708 | A | 10/1993 | Perry et al. | |
| 5,435,351 | A * | 7/1995 | Head | 138/111 |
| 5,505,260 | A | 4/1996 | Andersen et al. | |
| 5,577,925 | A | 11/1996 | Schnatzmeyer et al. | |
| 5,645,438 | A | 7/1997 | Cairns | |
| 5,645,483 | A | 7/1997 | Cushman | |
| 5,727,630 | A | 3/1998 | Brammer | |

(Continued)

FOREIGN PATENT DOCUMENTS

| | | |
|---|---|---|
| GB | 2318397 | 4/1998 |

(Continued)

OTHER PUBLICATIONS

Intelligent Wells, "Optical Fiber Technology," dated Oct. 2002.

(Continued)

*Primary Examiner*—Brian Healy
*Assistant Examiner*—Charlie Peng
(74) *Attorney, Agent, or Firm*—Smith IP Services, P.C.

(57) ABSTRACT

A deep water subsea tree completion having a distributed temperature sensing system. In a described embodiment, a method of installing an optical fiber in a well includes the steps of: conveying an optical fiber section into the well; and monitoring a light transmission quality of the optical fiber section while the section is being conveyed into the well.

21 Claims, 2 Drawing Sheets

U.S. PATENT DOCUMENTS

| | | | | |
|---|---|---|---|---|
| 5,778,978 | A | 7/1998 | Crow | |
| 5,803,167 | A | 9/1998 | Bussear et al. | |
| 5,831,156 | A | 11/1998 | Mullins | |
| 5,947,198 | A | 9/1999 | McKee et al. | |
| 6,006,828 | A | 12/1999 | Kluth et al. | |
| 6,017,227 | A * | 1/2000 | Cairns et al. | 439/138 |
| 6,062,073 | A | 5/2000 | Patton et al. | |
| 6,152,608 | A | 11/2000 | Ghara et al. | |
| 6,186,229 | B1 | 2/2001 | Martin et al. | |
| 6,281,489 | B1 | 8/2001 | Tubel et al. | |
| 6,302,203 | B1 | 10/2001 | Rayssiguier et al. | |
| 6,332,787 | B1 | 12/2001 | Barlow et al. | |
| 6,349,770 | B1 | 2/2002 | Brooks et al. | |
| 6,378,610 | B2 | 4/2002 | Rayssiguier et al. | |
| 6,439,778 | B1 | 8/2002 | Cairns | |
| 6,464,405 | B2 | 10/2002 | Cairns et al. | |
| 6,478,091 | B1 | 11/2002 | Gano | |
| 6,527,052 | B2 | 3/2003 | Ringgenberg et al. | |
| 6,568,481 | B2 | 5/2003 | Koehler et al. | |
| 6,666,274 | B2 * | 12/2003 | Hughes | 166/385 |
| 6,684,950 | B2 | 2/2004 | Patel | |
| 6,736,545 | B2 | 5/2004 | Cairns et al. | |
| 6,758,271 | B1 | 7/2004 | Smith | |
| 6,758,272 | B2 | 7/2004 | Bixenman et al. | |
| 6,766,853 | B2 * | 7/2004 | Restarick et al. | 166/242.6 |
| 6,837,310 | B2 | 1/2005 | Martin | |
| 6,874,361 | B1 | 4/2005 | Meltz et al. | |
| 6,933,491 | B2 * | 8/2005 | Maida, Jr. | 250/227.14 |
| 6,951,252 | B2 | 10/2005 | Restarick | |
| 6,983,796 | B2 | 1/2006 | Bayne et al. | |
| 2002/0014340 | A1 | 2/2002 | Johnson | |
| 2002/0125008 | A1 | 9/2002 | Wetzel et al. | |
| 2002/0162666 | A1 | 11/2002 | Koehler et al. | |
| 2003/0141075 | A1 | 7/2003 | Bixenman et al. | |
| 2003/0192708 | A1 | 10/2003 | Koehler et al. | |
| 2003/0196820 | A1 | 10/2003 | Patel | |
| 2003/0213598 | A1 * | 11/2003 | Hughes | 166/380 |
| 2004/0065439 | A1 | 4/2004 | Tubel et al. | |
| 2004/0173350 | A1 * | 9/2004 | Wetzel et al. | 166/253.1 |
| 2004/0256127 | A1 | 12/2004 | Brenner et al. | |
| 2004/0256137 | A1 | 12/2004 | Bertini et al. | |
| 2005/0092501 | A1 * | 5/2005 | Chavers et al. | 166/386 |
| 2005/0109518 | A1 | 5/2005 | Blacklaw | |

FOREIGN PATENT DOCUMENTS

| | | |
|---|---|---|
| WO | WO 86/02173 | 4/1986 |
| WO | WO 03/046428 | 6/2003 |
| WO | WO 2005/054801 | 6/2005 |

OTHER PUBLICATIONS

Intelligent Wells, "Oil Field Applications of Hydroptics Technology," dated Oct. 2002.
World Oil, "World's First Multiple Fiber-Optic Intelligent Well," dated Mar. 2003.
Underwater Magazine, "Underwater Mateable Connectors in the Military and Telecom Sectors," dated Sep./Oct. 2002.
Sea Technology, "The Ruggedization of Hybrid Wet-Mate Connectors," dated Jul. 2000.
Sea Technology, "Optical Fiber and Connectors: Critical for Future Subsea Systems," undated.
OTC 15323, "The Development and Application of HT/HP Fiber-Optic Connectors for Use on Subsea Intelligent Wells," dated 2003.
Journal of Petroleum Technology, "Development of HP/HT Fiber-Optic Connectors for Subsea Intelligent Wells," dated Aug. 2003.
Sea Technology, "Hybrid Wet-Mate Connectors: 'Writing the Next Chapter'," dated Jul. 1997.
Tronic, "Tronic Fibre Optic Wellhead Feedthrough Connectors," undated.
Tronic, "Firefly Project," undated.
OTC 13235, "Extending Tieback Distances: Wet-Mate Connectors, Enabling Technologies for Critical Systems Developments," dated 2001.
Ocean Design, "Underwater Mateable Connectors: Enabling Technology and the Next Step in Performance for Navy and Telecom Applications," Presented at Underwater Intervention Conference, 2002.
W Magazine, "Intelligent Well Completion, The Next Steps," dated Sep. 2002.
Production Optimization, "Intelligent Completions," undated.
Seacon, "Microstar, 4-Channel, Wet-Mate, Optical Connector," undated.
Ocean Design, Inc., "Ocean Design Introduces New I-CONN Product Line," dated Jul. 22, 2002.
Weatherford, "Intelligent Well Briefing," dated May 14, 2003.
"Pioneering Fibre Optic Completion Installation in the Mahogany Field, Offshore Trinidad," undated.
Pes, "Model Fo Fibre Optic Orientating Disconnect Head," dated Oct. 23, 2000.
SPE 71676, "The Use of Fiber-Optic Distributed Temperature Sensing and Remote Hydraulically Operated Interval Control Valves for the Management of Water Production in the Douglas Field," dated 2001.
SPE 84324, "Brunei Field Trial of a Fibre Optic Distributed Temperature Sensor (DTS) System in a 1,000 m Open Hole Horizontal Oil Producer," dated 2003.
Halliburton, "X-Line® and R-Line® Landing Nipples and Lock Mandrels; Set and Lock Reliability in Subsurface Flow Control Equipment With a Total Completion Package", dated Mar. 1997.
Focal Technologies Corporation, Product Brochure for Model 286, dated Apr. 15, 2003.
Office Action for U.S. Appl. No. 10/680,053, dated Jun. 11, 2004.
U.S. Appl. No. 10/680,053, filed Oct. 7, 2003.
U.S. Appl. No. 10/828,085, filed Apr. 20, 2004.
U.S. Appl. No. 10/680,625, filed Oct. 7, 2003.
U.S. Appl. No. 10/680,440, filed Oct. 7, 2003.
The Expro Group brochure, "Tronic Fibre Optic Wellhead Feedthrough Connectors", undated.
Seacon brochure, "Fiber Optic Connectors", undated.
Ocean Design, Inc. brochure, "NRH Connector", undated.
Ocean Design, Inc. brochure, "Hybrid Wet-Mate", 2000.
Ocean Design, Inc. brochure, "I-CONN; Wet-Mateable Optical Connector", 2000.
Seacon Advanced Products data sheets, pp. 22-1 through 22-20.
International Search Report for PCT/US04/01857.
U.S. Appl. No. 10/790,908, filed Mar. 2, 2004.
Office Action for U.S. Appl. No. 10/680,053, dated Nov. 8, 2004.
Office Action for U.S. Appl. No. 10/680,625, dated Jan. 26, 2005.
Search Report for United Kingdom application No. GB 0507890.2.
Office Action for U.S. Appl. No. 10/680,053, dated Mar. 8, 2005.
Search Report for PCT/US04/01863.
Search Report for PCT/US04/01856.
U.S. Appl. No. 10/873,849, filed Jun. 22, 2004.
Norfolk Wire & Electronics, "Optical Fiber Splice Protectors—FSP", dated 2003.
Office Action for U.S. Appl. No. 10/680,625, dated Jun. 27, 2005.
Office Action for U.S. Appl. No. 10/680,440, dated Jul. 6, 2005.
Office Action for U.S. Appl. No. 10/680,053, dated Jul. 6, 2005.
Otis Engineering drawing No. 41UP58701 dated May 4, 1993.
Halliburton Energy Services drawing No. 42 oo 210 dated Apr. 7, 2001.
Halliburton presentation entitled, "DTS Conceptual Completions", Dec. 3, 2002.
Halliburton presentation entitled, "Greater Plutonio Completions Workshop", Mar. 12, 2003.
Office action for U.S. Appl. No. 10/680,053, dated Oct. 21, 2005.
International Preliminary Report on Patentability for PCT/US2004/001863.
International Preliminary Report on Patentability for PCT/US2004/001856.
International Preliminary Report on Patentability for PCT/US2004/001857.
Written Opinion for PCT/US2004/001863.

Written Opinion for PCT/US2004/001856.
Written Opinion for PCT/US2004/001857.
Office Action for U.S. Appl. No. 10/873,849, dated May 5, 2006.
Office Action for U.S. Appl. No. 10/680,440, dated Jul. 5, 2006.
Office Action for U.S. Appl. No. 11/038,369, dated Jul. 11, 2006.
Office Action for U.S. Appl. No. 11/038,369, dated Feb. 14, 2006.
Office Action for U.S. Appl. No. 10/680,625, dated Mar. 9, 2006.
Office Action for U.S. Appl. No. 10/680,440, dated Jan. 13, 2006.
Office Action for U.S. Appl. No. 10/680,053, dated Mar. 10, 2006.
Office Action for U.S. Appl. No. 10/828,085, dated Mar. 22, 2006.

* cited by examiner

DISTRIBUTED TEMPERATURE SENSING IN DEEP WATER SUBSEA TREE COMPLETIONS

BACKGROUND

The present invention relates generally to operations performed and equipment utilized in conjunction with subterranean wells and, in an embodiment described herein, more particularly provides methods and apparatus for distributed temperature sensing in deep water subsea tree completions.

Distributed temperature sensing (DTS) is a well known method of using an optical fiber to sense temperature along a wellbore. For example, an optical fiber positioned in a section of the wellbore which intersects a producing formation or zone can be used in determining where, how much and what fluids are being produced from the zone along the wellbore.

Installation of DTS systems in deep water subsea tree completions could be made less risky and, therefore more profitable, if a fault in a light path of the optical fiber could be identified prior to final installation of the optical fiber in the well. This would enable the fault to be remedied before the riser is removed and the tree is installed. Presently, faults in the optical fiber light path are discovered after the tree is installed, at which time it is very difficult, expensive and sometimes cost-prohibitive, to troubleshoot and repair the faults.

For these reasons and others, it may be seen that it would be beneficial to provide improved methods and apparatus for installation of distributed temperature sensing systems in deep water subsea tree completions. These methods and apparatus will find use in other applications, and in achieving other benefits, as well.

SUMMARY

In carrying out the principles of the present invention, in accordance with an embodiment thereof, an optical fiber installation system and method are provided which decrease the risks associated with distributed temperature sensing in deep water subsea tree completions. The system and method enable a light transmission quality of an optical fiber installation to be monitored while the optical fiber is being installed, thereby permitting faults to be detected quickly.

In one aspect of the invention, a method of installing an optical fiber in a well is provided. The method includes the steps of: conveying an optical fiber section into the well; and monitoring a light transmission quality of the optical fiber section while the section is being conveyed into the well.

In another aspect of the invention, a method of installing an optical fiber in a well includes the steps of: conveying an assembly at least partially into the well with an optical fiber section attached to the assembly, the assembly being conveyed on another assembly; monitoring a light transmission quality of the optical fiber section during the conveying step by transmitting light through the optical fiber section; and then disconnecting the assemblies.

In yet another aspect of the invention, an optical fiber well installation system is provided. The system includes a first assembly conveyed at least partially into the well by a second assembly. An optical connector is attached to each of the first and second assemblies. The optical connectors are connected in order to transmit light through the connected optical connectors between a first optical fiber section attached to the first assembly and a second optical fiber section attached to the second assembly. A light transmitting quality monitor may be connected to the second optical fiber section while the second assembly conveys the first assembly into the well.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
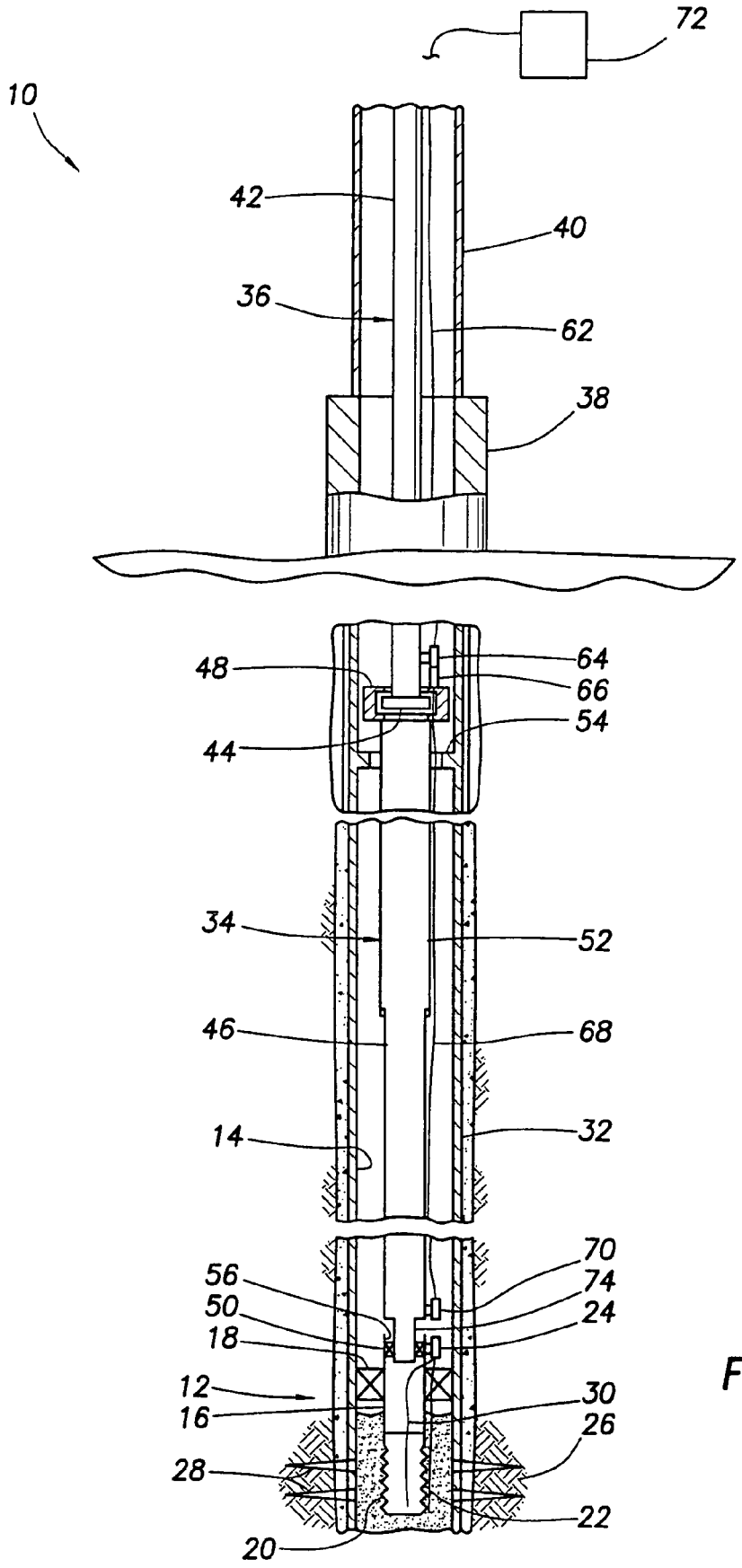
FIG. 1 is a schematic partially cross-sectional view of an optical fiber installation system embodying principles of the present invention.

Representatively illustrated in FIG. 1 is an optical fiber installation system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the system 10 and associated method, a completion assembly 12 is installed in a wellbore 14. The completion assembly 12 may be gravel packed in the wellbore 14, in which case the assembly may include a tubular completion string 16 with a well screen 20 suspended below a packer 18. However, it is to be clearly understood that other types of assemblies and other types of completions may be used in keeping with the principles of the invention.

The assembly 12 further includes a section of optical fiber 22 extending downwardly from an optical connector 24 attached at an upper end of the assembly, through the packer 18, and exterior to the screen 20 through a portion of the wellbore 14 which intersects a formation or zone 26. The section 22 could instead, or in addition, be positioned internal to the screen 20, as depicted for section 30, which extends downwardly from the connector 24 and into the interior of the string 16. The section 22 could also, or alternatively, be positioned external to a casing string 32 lining the wellbore 14, or could be otherwise positioned, without departing from the principles of the invention.

The zone 26 is in communication with the intersecting portion of the wellbore 14 via perforations 28. Other means could be provided for communicating between the zone 26 and wellbore 14, for example, the portion of the wellbore intersecting the zone could be completed open hole, etc.

The section 22 is used in the system 10 for distributed temperature sensing in the wellbore 14. For example, the section 22 may be used to determine the temperature of fluid flowing between the zone 26 and the wellbore 14 in the portion of the wellbore intersecting the zone. The temperature of the fluid may be determined at distributed locations along the intersection between the wellbore 14 and the zone 26, in order to determine where, how much and what fluids are being produced from, or injected into, the zone along the wellbore.

A production tubing assembly 34 is conveyed into the wellbore 14 by use of a work string assembly 36 to suspend the production tubing assembly from a rig (not shown) positioned above a subsea wellhead 38. The production tubing assembly 34 is conveyed by the work string assembly 36 through a riser 40 connecting the rig to the wellhead 38, through the wellhead, and into the wellbore 14. The work string assembly 36 includes a tubular work string 42 having a releasable connection 44 at a lower end.

The production tubing assembly 34 includes a production tubing string 46 having an anchor 48 at an upper end, a seal 50 at a lower end, and a telescoping travel or extension joint 52 between the ends. As schematically depicted in FIG. 1, the anchor 48 is a tubing hanger which engages a shoulder 54 to secure the tubing string 46 in the wellbore 14. The releasable connection 44 is a hanger running tool which, for example, uses a releasable latch to disconnect the work string 42 from the tubing string 46 after the tubing hanger 48 has been "set" by engaging the shoulder 54.

Other types of anchors and other means of setting anchors may be used in keeping with the principles of the invention. For example, the anchor could include slips which grip the wellbore 14 to set the anchor, the anchor could include a latch which engages a corresponding profile, etc.

Figure 2:
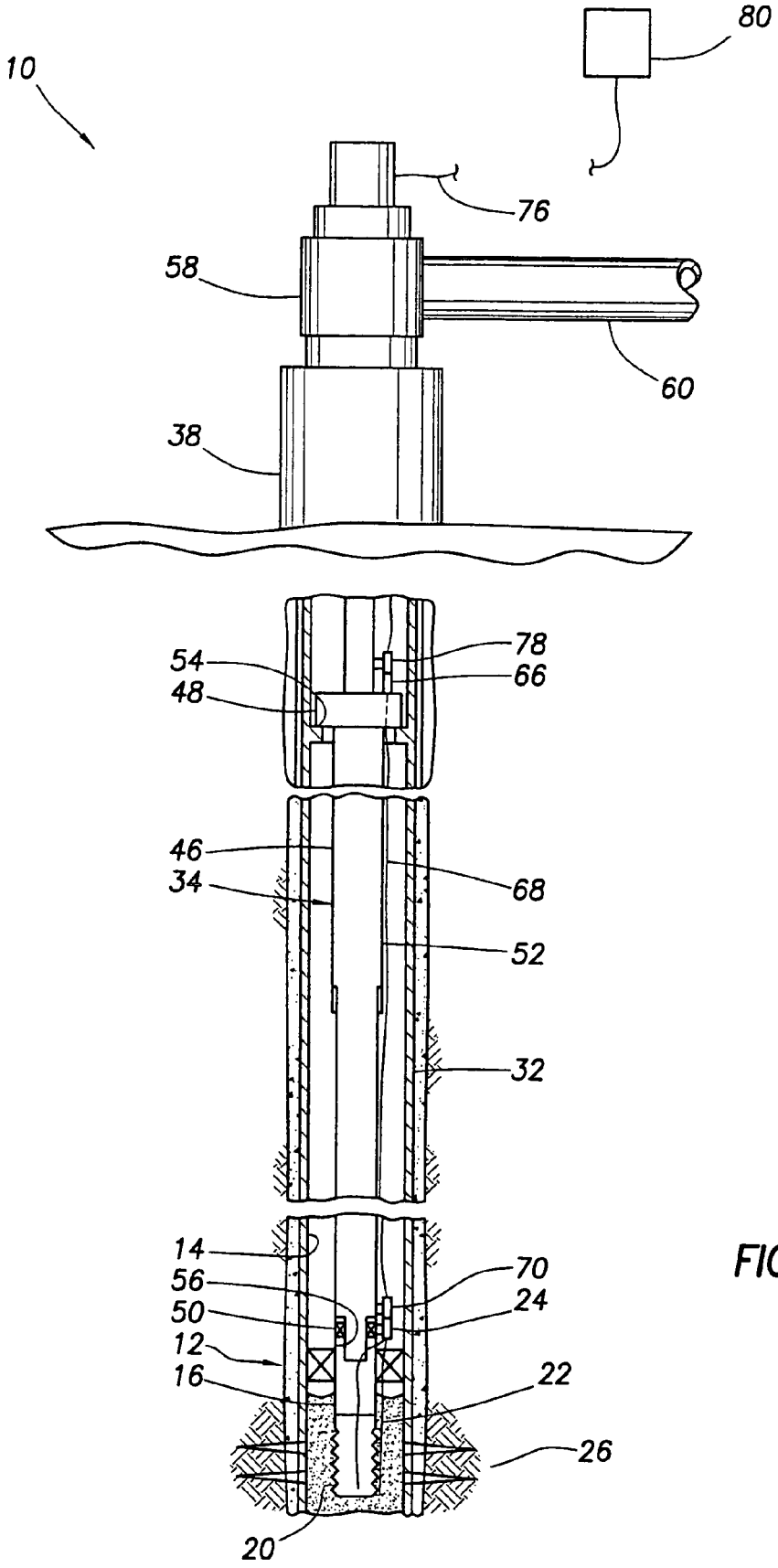
FIG. 2 is a schematic partially cross-sectional view of the system of FIG. 1, in which additional steps of an optical fiber installation method have been performed.

The travel joint 52 permits the seal 50 to engage a seal bore 56 at an upper end of the completion string 16 prior to the anchor 48 engaging the shoulder 54. After the seal 50 is received in the seal bore 56, the travel joint 52 allows the tubing string 46 to axially compress somewhat as the anchor 48 continues displacing downwardly to engage the shoulder 54. This configuration is depicted in FIG. 2, wherein it may be seen that the seal 50 is sealed in the seal bore 56, and the anchor 48 is engaged with the shoulder 54.

When the work string 42 has been disconnected from the tubing string 46, the work string is retrieved from the well. The riser 40 is removed, and a tree 58 is installed on the wellhead 38 to connect the well to a pipeline 60. Note that, if a fault is discovered in the system 10 after the tree 58 is installed, it will be very difficult, time-consuming and, therefore, expensive to troubleshoot and repair the system.

However, in a very beneficial feature of the system 10, faults in the system can be detected during installation when the faults are far easier to troubleshoot and repair. As depicted in FIG. 1, the work string 42 has a section of optical fiber 62 attached thereto. The optical fiber section 62 is coupled to an optical connector 64 at the lower end of the work string 42.

The optical connector 64 is connected to another optical connector 66 at an upper end of the production tubing string 46. Preferably, the connector 66 is positioned above the anchor 48, for convenient connection to the connector 64, and for reasons that are described more fully below. Another optical fiber section 68 is coupled to, and extends between, the connector 66 and another optical connector 70 at a lower end of the tubing string 46.

As the tubing string 46 is conveyed into the wellbore 14 by the work string 42, the upper optical fiber section 62 is optically connected to the section 68 via the connected connectors 64, 66. A light transmitting quality (such as an optical signal transmitting capability, or optical signal loss) of the sections 62, 68 and/or connectors 64, 66 may be monitored by connecting a monitor 72 to the section 62 and transmitting light from the monitor, through the section 62, through the connectors 64, 66, and into the section 68. For example, the monitor 72 may include a light transmitter (such as a laser) for transmitting light into the section 62, an electro-optical converter (such as a photodiode) for receiving light reflected back to the monitor and converting the light into electrical signals, and a display (such as a video display or a printer) for observing measurements of the light transmitting quality indicated by the signals.

If there is a fault in the sections 62, 68 or connectors 64, 66, the monitor 72 can detect the fault before or after the anchor 48 is set, and preferably before the work string 42 is disconnected from the tubing string 46. Of course, it would be very beneficial to detect a fault before the anchor 48 is set, since the tubing string 46 could fairly easily be retrieved from the well for repair at that point. It would also be beneficial to use the monitor 72 to verify the light transmitting quality of the sections 62, 68 and connectors 64, 66 after the anchor 48 is set, for example, to check for faults which may have occurred due to the anchor setting process, or due to other causes. Furthermore, it is desirable to use the monitor 72 to measure the light transmitting quality of the system 10 prior to disconnecting the work string 42 from the tubing string 46, and retrieving the work string from the well.

The monitor 72 may also be used to measure the light transmitting quality of the optical fiber section 22 after the connector 70 has been connected to the connector 24. This connection between the connectors 24, 70 is made when the tubing string 46 is conveyed into the wellbore 14 and the lower end of the tubing string engages the upper end of the completion string 16. This engagement connects the connectors 24, 70 and optically connects the sections 68, 22. For example, a rotationally orienting latch 74 may be used at the lower end of the tubing string 46 to align the connectors 24, 70 when the tubing string engages the completion string 16.

By monitoring the light transmitting quality of the connectors 24, 70 using the monitor 72, the optical connection between the sections 68, 22 may be verified before the anchor 48 is set. If the light transmitting quality of the connection between the connectors 24, 70 is poor, indicating that the connectors may not be fully engaged, or that debris may be hindering light transmission between the connectors, etc., then the connectors 24, 70 may be repeatedly disengaged by raising the tubing string 46, and then re-engaged by lowering the tubing string, until a good light transmitting quality through the connectors is achieved.

Of course, in this process a fault may be detected in another part of the system 10. For example, a fault could be detected in the section 22 while the light transmitting quality of the connectors 24, 70 is being monitored. Thus, it may be seen that the light transmitting quality of any element of the system 10 may be monitored while the light transmitting quality of any other element, or combination of elements, is monitored at the same time.

After the light transmitting quality of each of the sections 68, 22 and/or connections between the connectors 24, 70 and/or connectors 64, 66 have been verified, the work string 42 is disconnected from the tubing string 46. The disconnection of the work string 42 may be accomplished in any manner, such as by raising the work string, rotating the work string, etc. If the work string 42 is to be rotated, then an optical swivel (not shown) may be used on the work string to permit at least a portion of the work string to rotate relative to the connector 64. A suitable optical swivel is the Model 286 fiber optic rotary joint available from Focal Technologies Corporation of Nova Scotia, Canada.

This disconnection of the work string 42 from the tubing string 46 also disconnects the connectors 64, 66 from each other. The work string 42 is then retrieved from the well. The riser 40 is removed and the tree 58 is installed as depicted in FIG. 2.

The tree 58 has another optical fiber section 76 extending through it between an optical connector 78 and another monitor 80. The monitor 80 may actually be a conventional distributed temperature sensing optical interface, which typically includes a computing system for evaluating optical signals transmitted through an optical fiber in a well. Thus, by connecting the connectors 78, 66, the section 76 is placed in optical communication with the section 22, permitting distributed temperature sensing in the portion of the wellbore 14 intersecting the zone 26. The positioning of the connector 66 above the anchor 48 enables convenient connection between the connectors 78, 66 when the tree 58 is installed.

The monitor 72 may also be a conventional distributed temperature sensing optical interface which is used to monitor the light transmitting quality of the system 10 during installation. The monitor 72 may be the same as the monitor 80, or it may be a different monitor, or different type of monitor.

Note that the connectors 24, 70, 64, 66, 78 are preferably optical connectors of the type known to those skilled in the art as "wet mate" or "wet connect" connectors. These types of connectors are specially designed to permit a connection to be formed between the connectors in a fluid. In the wellbore 14, the connectors 24, 70 are optically connected in fluid, the connectors 64, 66 are initially connected and then are disconnected in fluid, and the connectors 66, 78 are optically connected in fluid.

In a manner similar to that described above in which a light transmitting quality of the sections 62, 68 and/or connectors 64, 66 on the tubing string 46 and work string 42 are monitored during installation of the tubing string, a light transmitting quality of the section 22 and/or 30 and/or connector 24 may be monitored during installation of the completion assembly 12. For example, the completion assembly 12 could be installed using the work string 42 or another string and, during this installation, light could be transmitted through the section 22 and/or 30 and/or connector 24 (and a connector connected to the connector 24, and a optical fiber section on the work string, etc.) to monitor a light transmitting quality of these elements. The work string used to install the completion assembly 12 could be a gravel packing string, and the light transmitting quality of the section 22 and/or 30 and/or connector 24 (and a connector connected to the connector 24, and a optical fiber section on the work string, etc.) could, thus, be monitored during and/or after the gravel packing operation.

Although the monitoring of a light transmitting quality of a specific number of optical fiber sections 22, 30, 62, 68, 76 and associated connectors 24, 64, 66, 70, 78 has been described above, it will be readily appreciated that any number of optical fiber sections and connectors may be used, in keeping with the principles of the invention. For example, the tubing string 34 could be installed in multiple trips into the wellbore 14, in which case additional optical fiber sections and connectors may be used on the separately installed portions of the tubing string, each of which could be monitored during its installation. As another example, formations or zones in addition to the single zone 26 described above could be completed using separate completion assemblies, each of which may have its associated optical fiber section(s) and connector(s), and each of the optical fiber sections and connectors may be monitored during installation. As yet another example, the tubing string 34 and completion assembly 12 could be installed in a single trip into the wellbore 14, in which case there may be no need for the separate optical fiber sections 68 and 22 and/or 30, or connectors 24, 70.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. An optical fiber well installation system, comprising:

a first assembly;

a second assembly used to convey the first assembly at least partially into a well;

an optical connector attached to each of the first and second assemblies, the optical connectors being connected in order to transmit light through the connected optical connectors between a first optical fiber section attached to the first assembly and a second optical fiber section attached to the second assembly; and wherein the first and the second assemblies are releasably secured to each other, so that the first assembly is detachable from the second assembly within the well for retrieval of the second assembly from the well.

2. The system of claim 1, wherein the optical connectors are disconnectable along with the first and second assemblies being released for displacement relative to each other.

3. The system of claim 1, wherein the optical connectors are disconnectable along with retrieval of the second assembly.

4. The system of claim 1, further comprising a light transmission quality monitor connected to the second section.

5. The system of claim 4, wherein the monitor measures a light transmission quality of the first section.

6. The system of claim 4, wherein the monitor measures a light transmission quality of the second section.

7. The system of claim 4, wherein the monitor measures a light transmission quality of the connected optical connectors.

8. The system of claim 4, wherein the light transmission quality indicates whether the optical connectors are operatively connected.

9. The system of claim 1, wherein further optical connectors are connected in the well when the first assembly is conveyed into the well by the second assembly.

10. The system of claim 9, further comprising a light transmission quality monitor connected to the second section, the monitor measuring a light transmission quality of the further optical connectors connected in the well.

11. The system of claim 10, wherein the light transmission quality indicates whether the further optical connectors are operatively connected.

12. The system of claim 1, wherein the optical connectors are positioned above an anchor on the first assembly, the anchor securing the first assembly in the well.

13. The system of claim 12, wherein the anchor is a tubing hanger.

14. The system of claim 12, wherein the optical connectors are positioned between the anchor and a light transmission quality monitor connected to the first section.

15. The system of claim 1, wherein the first assembly is a production tubing string and the second assembly is a work string.

16. The system of claim 15, wherein the production tubing string engages a completion string in the well, thereby connecting further optical connectors in the well.

17. The system of claim 16, wherein a light transmission quality monitor is connected to the first section.

18. The system of claim 17, wherein the monitor measures a quality of light transmission through the optical connectors attached to the work and production tubing strings, through the first and second sections, and through the further optical connectors connected in the well.

19. The system of claim 16, wherein the completion string is gravel packed in the well.

20. The system of claim 19, wherein an optical transmission quality of a third optical fiber section attached to the completion string is monitored while the completion string is gravel packed in the well.

21. The system of claim 19, wherein an optical transmission quality of a third optical fiber section attached to the completion string is monitored after the completion string is gravel packed in the well.

* * * * *